US006199609B1

(12) United States Patent
Harper et al.

(10) Patent No.: US 6,199,609 B1
(45) Date of Patent: Mar. 13, 2001

(54) APPARATUS AND METHOD FOR FORMING A BASKET BOTTOM

(75) Inventors: Tom Harper; Duane Bice, both of Nashport; Jack Hindel, Frazeysburg; Tim Teal, Mount Vernon; Leane Lefever, Frazeysburg; Vicki Lahna, Coshocton; Todd Miller, Nashport; Chris Corp, Coshocton, all of OH (US)

(73) Assignee: The Longaberger Company, Newark, OH (US)

( * ) Notice: Subject to any disclaimer, the term of this patent is extended or adjusted under 35 U.S.C. 154(b) by 0 days.

(21) Appl. No.: 09/126,822

(22) Filed: Jul. 31, 1998

Related U.S. Application Data

(63) Continuation-in-part of application No. 08/431,090, filed on Apr. 28, 1995, now Pat. No. 5,799,714.

(51) Int. Cl.[7] ..... B27J 1/00
(52) U.S. Cl. ..... 147/48
(58) Field of Search ..... 147/48; 29/463, 29/464

(56) References Cited

U.S. PATENT DOCUMENTS 285,053 * 9/1883 Miller ..... 147/48
450,114 * 4/1891 Snow ..... 147/48
597,624 * 1/1898 Titus ..... 147/48
1,116,820 * 11/1914 Huke ..... 147/48
1,311,086 * 7/1919 O'Loughlin et al. ..... 147/48
1,491,933 * 4/1924 Sullivan ..... 147/48
2,360,508 * 10/1944 Mitchell ..... 147/48
3,563,292 * 2/1971 Gordon et al. ..... 147/48
5,799,714 * 9/1998 Teal et al. ..... 147/48

* cited by examiner

*Primary Examiner*—John M. Husar
(74) *Attorney, Agent, or Firm*—Porter, Wright, Morris & Arthur LLP

(57) ABSTRACT

A working surface 14 is provided with a plurality of splint locators 15–18 and a bottom locating area 27 suitable for arranging basket splints 11A–C, 12A–C into a predetermined number and configuration of angularly related sets 11, 12. A slot 44, 45 and a linearly aligned set of sockets 48A–C, 49A–C are formed in the working surface 14 outwardly from two of the perimeter edge portions 21, 22 of the bottom locating area 27. An alignment rim 29, 30 is provided for positioning one end of each of the basket splints in one of the angularly related sets 11, 12. A bolt 50, 51 is slidably mounted in each of the slots 44, 45 and extends upwardly through each of the alignment rims 29, 30. A wing nut 56, 57 is threadedly mounted on each of the bolts 50, 51 for releasably tightening the alignment rims 29, 30 at selected sites on the working surface 14. A ring-headed pin 58, 59 extends downwardly through each of the alignment rims 29, 30 for releasably engaging a selected one of the sockets 48A–C, 49A–C.

20 Claims, 3 Drawing Sheets

APPARATUS AND METHOD FOR FORMING A BASKET BOTTOM

RELATED APPLICATION

This is a continuation-in-part of U.S. patent application Ser. No. 08/431,090 filed Apr. 28, 1995, now U.S. Pat. No. 5,799,714, the text of which is incorporated herein by reference.

BACKGROUND OF THE INVENTION

This invention relates generally to an apparatus and a method for facilitating the construction of hand-woven baskets, and more particularly to an apparatus and a method including a guide, or form, for constructing the bottom of a basket. The present invention assists in accurately positioning the splints that comprise the basket bottom panel and in allowing for variations in side wall height from one basket to the next.

Hand-made baskets are typically fabricated in a two-stage process in which the basket bottom is formed separately from the side walls. The bottom panel is constructed in a first, or "forming" step, and the side panels are constructed, with the aid of a basket mold, in a second, or weaving step.

During the bottom-forming step, centrally located portions of a plurality of elongated strips or splints of wood or other material are arranged in a multi-layered or woven pattern (typically a symmetrical crossing pattern), with the elongated free ends of the splints projecting outwardly from the center. The multi-layered or woven center becomes the bottom of the basket, and the free ends of the splints projecting outwardly from the center become the upsplints, i.e., the generally vertically extending members of the basket's side walls.

Because bottom panel construction may affect both the strength of the basket and the framework for the basket side walls, defects in basket bottom panels are particularly likely to result in baskets of inferior quality. When such defects occur, the likelihood of successful repair depends, in part, upon timely detection of the error. If the error is not found for some time after the bottom panel is completed, the bottom panel components are likely to be drier and less flexible than they were immediately after the panel was made, and are therefore more likely to break during repair. If the error is not detected until after the bottom panel is incorporated into a finished basket, repair will be even more difficult, if not impossible.

Consumer expectations with respect to basket quality are high, particularly in connection with premium and collectible baskets. Subtle irregularities and slight variations from basket to basket are acceptable, and indeed are desirable because they give hand-made baskets their special character. However, a basket with excessive irregularities and variations may be cosmetically displeasing, and therefore unacceptable to consumers, even if it is structurally sound. In addition, excessive irregularities in bottom panels decrease production efficiency by, for example, requiring a weaver to spend more time fitting the bottom panel to a basket mold in preparation for construction of the basket side panels.

To achieve more uniform, higher quality baskets, guides or forms have been used in the past to assist in properly positioning the elongated splints and constructing the multi-layered or woven bottom of the basket. Heretofore, each of these prior art bottom forms was substantially limited to use with a single size and shape of basket. As may be readily understood, the cumulative time and cost of constructing and storing these forms increased every time a new basket model was introduced. Although it was possible for an exceptionally skilled craftsman to produce baskets with different side wall heights on a single form, construction time and the chances of error for the typical craftsman were increased. Accordingly, a separate bottom form was typically provided for each differently sized and shaped basket.

In light of the disadvantages of the prior art, an apparatus is needed that can assist the basket former in positioning and aligning the elongated splints during bottom panel construction and that will allow the use of a single guide apparatus to produce baskets having different side panel heights.

SUMMARY AND OBJECTS OF THE INVENTION

The present invention is an apparatus for forming a basket bottom having a predetermined number and configuration of angularly related sets of basket splints and comprises a working surface; stop means for positioning on the working surface one end of each of the basket splints in one of the angularly related sets, site means for providing at least two stop locating sites on the working surface and fastening means for releasably securing the stop means to the working surface at a selected one of said at least two sites.

The present invention is also a method of forming a basket bottom having a predetermined number and configuration of angularly related sets of basket splints and comprises the steps of: selecting one of at least two stop locating sites provided on the working surface by site means; releasably securing stop means at the selected one of said at least two sites on the working surface by fastening means; positioning one end of each of the basket splints in one of the angularly related sets at said stop means; and arranging the basket splints into the predetermined number and configuration of angularly related sets.

A primary object of the present invention is to provide an apparatus and method for forming a bottom panel for a basket having a selected side panel height and, with some adjustment, for forming a bottom panel for a basket having a different side panel height. This and further objects and advantages may be understood in view of the following drawings and detailed description.

DETAILED DESCRIPTION OF THE PREFERRED EMBODIMENTS

Figure 1:
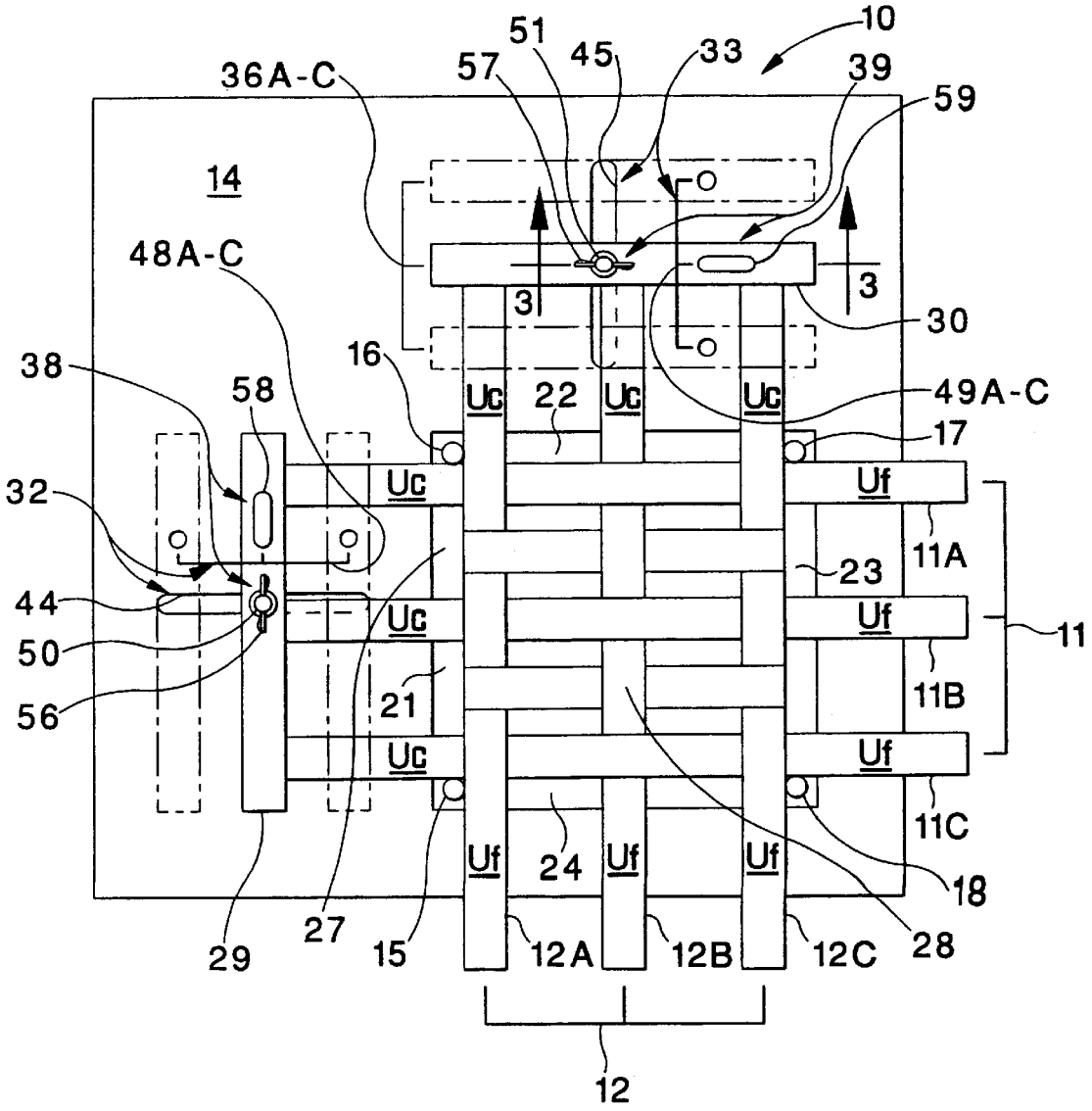
FIG. 1 is a top plan view of one embodiment of the basket bottom forming apparatus according to the present invention.

As illustrated in FIG. 1, one preferred embodiment of the present apparatus, generally designated 10, forms a basket bottom 28 having two angularly related sets 11, 12 of basket splints 11A–C, 12A–C disposed in an interlayered or woven and generally square configuration. Preferably, a plurality of splint locators 15, 16, 17, 18 are mounted or are mountable on a working surface 14 at or adjacent to first 21, second 22, third 23 and fourth 24 perimeter edge portions of a bottom locating area 27 to facilitate arranging the basket splints 12A–C, 14A–C into the generally square configuration. Stop means 29 is provided to position one end of each of the basket splints in one of the angularly related sets 11 outwardly from one of the perimeter edge portions 21, and another stop means 30 is provided to position one end of each of the basket splints in the other angularly related set 12 outwardly from an adjacent perimeter edge portion 22 of the bottom locating area 27. Site means, generally designated 32, provide three stop locating sites 35A–C on the working surface 14 for one of the angularly related sets 11 of basket splints outwardly from one of the perimeter edge portions 21, and site means 33 provide three stop locating sites 36A–C on the working surface 14 for the other angularly related set 12 outwardly from the adjacent perimeter edge portion 22 of the bottom locating area 27. Fastening means, generally designated 38, releasably secure the stop means 29 to the working surface 14 at a selected one of the stop locating sites 35A–C outwardly from the perimeter edge portion 21, and fastening means 39 releasably secure stop means 30 to the working surface 14 at a selected one & of the stop locating sites 36A–C outwardly from the adjacent perimeter edge portion 22.

Preferably, each of the stop means 29, 30 is comprised of an alignment rim approximately equal in length to the perimeter edge portion 21, 22 from which it is outwardly disposed. In addition, the bottom locating area 27 is preferably the approximate shape and size of the desired basket bottom 28.

FIG. 1 also illustrates the effect of having more than one stop locating site 35A–C, 36A–C for each of the stop means or alignment rims 29, 30. Those portions Uc of the basket splints 11A–C 12A–C extending from the first and second perimeter edges 21, 22 of the bottom locating area 27 to the first and second alignment rims 29, 30 are referred to herein as captured upsplints. After the basket bottom 28 is formed, the captured upsplints Uc are bent or otherwise formed into the vertically extending members of two of the basket's side walls. Thus, the lengths of the captured upsplints Uc correspond to or determine the height of two of the basket's side walls. By selecting the sites 35C, 36C closest to the perimeter edge portions 21, 22 and by securing the alignment rims 29, 30 thereto, the basket maker may use the present apparatus to form the bottom of a relatively shallow basket. By selecting the sites 35A, 36A furthest from the perimeter edge portions 21, 22, the basket maker is enabled to form the bottom of a relatively deep basket. Preferably, each of the alignment rims 29, 30 is at least as long as, is aligned with, and is parallel to the perimeter edge portion 21, 22 from which it is outwardly disposed. In this manner, the captured upsplints Uc in each set 11, 12 are substantially equal in length and the free ends thereof may be positioned against the appropriate alignment rim 29, 30 without dislocating the splints from the pattern facilitated by the splint locators 15–18. Preferably, the alignment rims 29, 30 are secured to the working surface 14 an equal distance outwardly from their respective perimeter edge portions 21, 22. In this manner, all of the captured upsplints Uc will be substantially equal in length.

As further illustrated in FIG. 1, the number of alignment rims 29, 30 provided on the present apparatus 10 preferably is equal to the number of sets 11, 12 of angularly related and interlayered basket splints and is also equal to one-half of the number of perimeter edge portions 21–24 of the bottom locating area 27. Typically, the basket splints 11A–C, 12A–C are precut to a length that provides free upsplints Uf, (i.e., those portions of the splints 11A–C, 12A–C extending outwardly from the third and fourth perimeter edge portions 23, 24 and away from the alignment rims 29, 30) that are at least as long as the captured upsplints Uc. In this manner, the basket side walls eventually formed from the free upsplints Uf will be at least as long or as tall as the side walls formed from the captured upsplints Uc. Typically, the basket maker selects basket splints with the desired positions of the alignment rims 29, 30 in mind so that the lengths of the splints are sufficient for the free upsplints Uf to be at least as long as the captured upsplints Uc.

Figure 2:
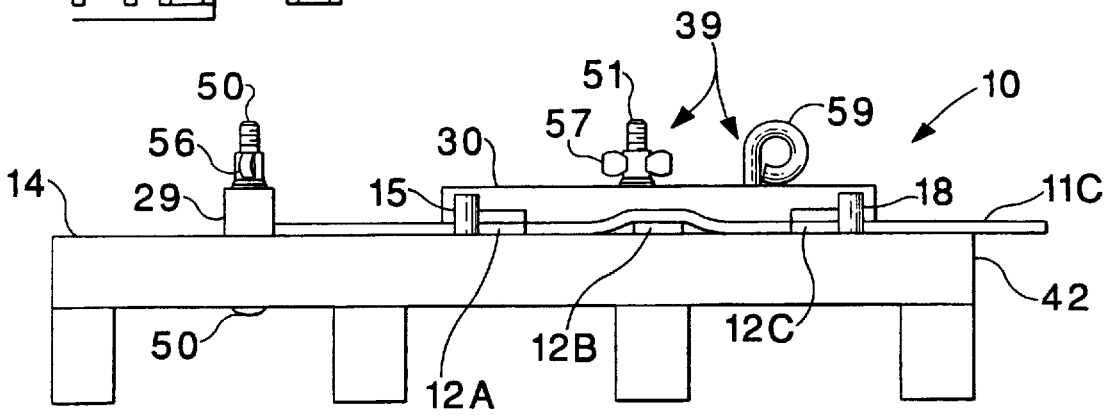
FIG. 2 is a front elevational view of a short legged, portable platform upon which the present basket bottom forming apparatus is carried.

As illustrated in FIG. 2, the present basket bottom forming apparatus 10 is preferably carried on a portable platform 42 suitable for mounting on a work stand or table (not shown) when in use and for storage when not in use. Preferably, the splint locators 15–18 are rigidly secured to the platform 42 in a pattern suitable for one particular shape and size of basket bottom. However, it would also be possible to provide a platform having a plurality of bores into which the splint locators could be inserted in various patterns so that it could be used to form basket bottoms having different predetermined numbers and configurations of angularly related sets of basket splints.

Figure 3:
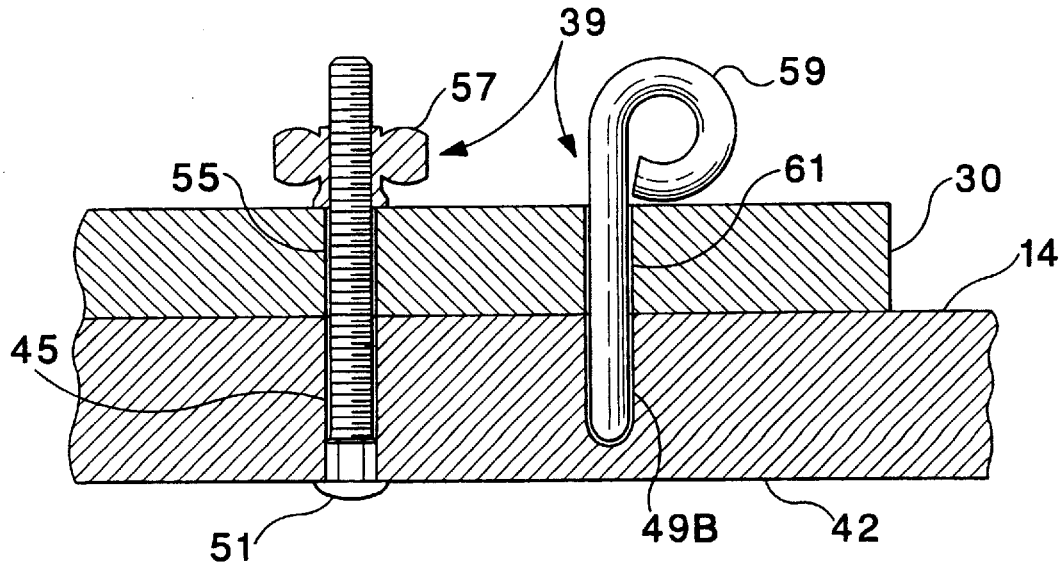
FIG. 3 is an enlarged sectional view taken along line 3—3 of FIG. 1 and particularly illustrates preferred site means and fastening means for the present basket bottom forming apparatus.

As variously illustrated in FIGS. 1, 2 and 3, the site means 32 and 33 are preferably identical to one another, although differently located on the working surface. Each of the site means 32, 33 preferably comprises, in part, a slot 44, 45 formed in the platform 42 and working surface 14 and disposed generally perpendicularly to, in spaced relation to and outwardly from the perimeter edge portion 21, 22. In addition to the slot 44, 45, each of the site means preferably comprises at least two or more spaced apart sockets, such as the illustrated three spaced apart sockets 48A–C, 49A–C, formed in the platform 42 and the working surface 14 and disposed in a line which is generally perpendicular to the perimeter edge portion 21, 22 from which the sockets are outwardly disposed. The number of sockets 48A–C may vary depending on the desired number of adjustments in the height of the basket walls.

As variously illustrated in FIGS. 1, 2 and 3, the fastening means 38, 39 are preferably identical to one another, although differently located on the working surface. Each of the fastening means 38, 39 preferably comprises, in part: a carriage bolt 50, 51 whose neck is slidably mounted in the slot 44, 45 in the platform 42 and working surface 14 and whose shaft extends upwardly through a centrally located bore 54, 55 in the alignment rim 29, 30. The fastening means 38, 39 also preferably comprises a wing nut 56, 57 threadedly mounted on a portion of the carriage bolt 50, 51 projecting above the alignment rim 29, 30. The fastening means 38, 39 further preferably comprises a ring-headed pin 58, 59 removably mounted in a laterally located bore 60, 61 in the alignment rim 29, 30 and extending into a selected one of the sockets 48A–C, 49A–C in the working surface 14 and the platform 42. The ring–headed pin 58, 59, once inserted through the lateral bore 60, 61 in the alignment rim 29, 30 and into the selected socket 48A–C, 49A–C, keeps the alignment rim from rotating and provides the basket maker with a means of properly positioning the alignment rim without a measuring instrument.

Alternatively, the site means 32, 33 and the fastening means 38, 39 may comprise any of several guides, channels, fasteners and/or clamps mounted on or in the alignment rims and the working surface. In addition, such alternative site and fastening means may permit the alignment rims to be positioned at any selected site within a range, rather than being limited to the preselected sites 35A–C, 36A–C as shown.

As variously illustrated in FIGS. 1, 2 and 3, the basket bottom 28 is preferably formed in the following manner. The basket maker selects from storage the platform 42 whose splint locators 15–18 and bottom locating area 27 are disposed on the working surface 14 to form the rectangular or square basket bottom 28 from two angularly related sets 11, 12 of basket splints. The platform 42 is secured on a stand or work station (not shown). The operator selects the basket splints 11A–C, 12A–C of sufficient length so that the basket side walls which are later formed from the upsplints Uc, Uf will be the required height. The positions of the alignment rims 29, 30 on the working surface 14 are then adjusted, if necessary, to obtain captured upsplints Uc of proper length. To adjust the positions of the alignment rims, the operator removes the ring–headed pins 58, 59 from the sockets 48, 49 in the working surface 14 and platform 42, unscrews the wing nuts 56, 57 sufficiently to allow the bolts 50, 51 to slide in the slots 44, 45 and slides the alignment rims 29, 30 to the sites 35A–C, 36A–C which will provide captured upsplints Uc of suitable length. The ring-headed pins 58, 59 are then inserted into the pin-receiving sockets 48, 49 at the selected sites 35, 36, and the wing nuts 56, 57 are tightened to secure the alignment rims 29, 30 to the working surface 14 at the selected sites 35, 36. The basket splints 11A–C, 12A–C are then arranged on the working surface 14 in a manner facilitated by the splint locators 15–18 into the two angularly related and interlayered sets 11, 12. In arranging the splints in the desired pattern, care is taken to position one end of each of the splints in the first set 11 against the alignment rim 29 disposed approximately perpendicularly thereto and to position one end of each of the splints in the second set 12 against the alignment rim 30 disposed approximately perpendicularly thereto. In the manner disclosed in U.S. patent application Ser. No. 08/431,090, the operator then tacks or otherwise secures overlapping portions of the splints in the basket bottom together and adds reinforcing members (not shown) as desired. The basket bottom 28 and the outwardly extending upsplints Uc, Uf are then removed from the present forming apparatus 10, whereupon the present apparatus can be used to make another basket bottom/upsplint assembly of the same shape and size as the previous one, or can be adjusted to change the length of the upsplints, or can be placed back in storage.

Figure 4:
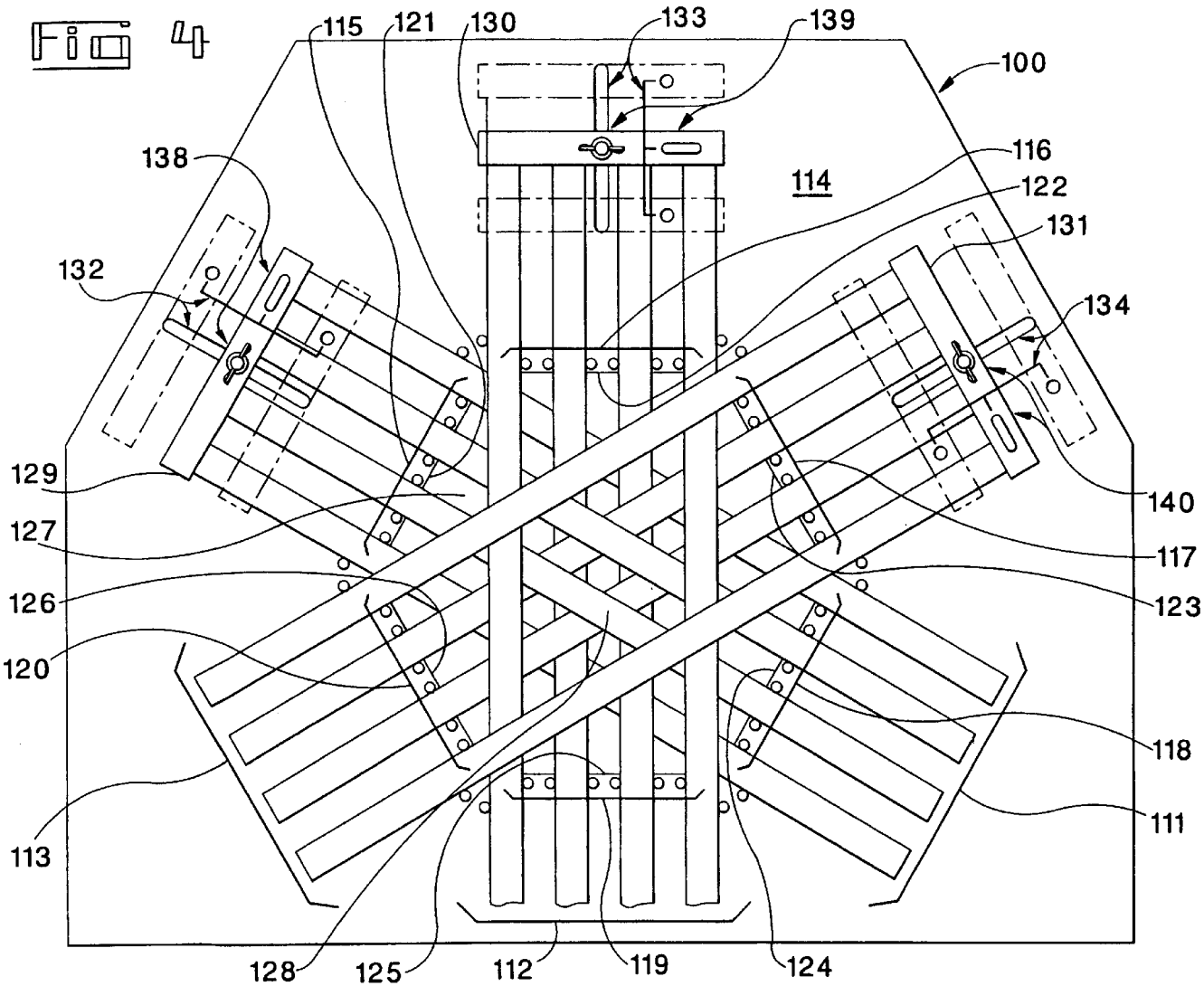
FIG. 4 is a top plan view of an alternative embodiment of the present basket forming apparatus.

As illustrated in FIG. 4, another preferred embodiment the present forming apparatus, generally designated 100, is adapted to form a basket bottom 128 having first 111, second 112 and third 113 angularly related sets of basket splints disposed in a woven or interlayered and generally hexagonal configuration. Preferably, a plurality of sets of splint locators 115, 116, 117, 118, 119, 120 are mounted on a working surface 114 at or near first 121, second 122, third 123, fourth 124, fifth 125 and sixth 126 perimeter edge portions of a hexagonal bottom locating area 127 to facilitate arranging the basket splints into the predetermined hexagonal configuration. Stop means 129, 130, 131 are provided for each of the angularly related sets 111–113 of basket splints for positioning one end of each of the basket splints in one of the sets outwardly from one of the three perimeter edge portions 121, 122, 123 of the bottom locating area 127. Site means, generally designated 132, 133, 134 are provided to establish three stop locating sites 135A–C, 136A–C, 137A–C on the working surface 114 for each of the angularly related sets 111–113 outwardly from the three perimeter edge portions 121, 122, 123. Fastening means, generally designated 138, 139, 140 are provided for releasably securing the stop means 129, 130, 131 to the working surface 114 at a selected one of the stop locating sites 135B, 136B, 137B for each of the angularly related sets 111–113 of basket splints outwardly from the three perimeter edge portions 121–123.

Preferably, and as illustrated in FIGS. 3 and 4, each of the stop means 129–131 is comprised of an alignment rim approximately equal in length to the perimeter edge portion 121–123 from which it is outwardly disposed; each of the site means 132–134 is comprised of a slot and three linearly aligned sockets, both the slot and line of sockets being disposed generally perpendicularly to the perimeter edge portion 121–123 from which they are outwardly disposed; and each of the fastening means 138–140 is comprised of a bolt slidably mounted in the slot and projecting upwardly through a centrally located bore in the alignment rim, a wing nut mounted on a threaded portion of the bolt extending above the alignment rim, and a ring-headed pin extending downwardly through a laterally located bore in the alignment rim and into one of the sockets. In this manner, the alignment rim may be releasably secured to the working surface 114 in generally parallel relation to the perimeter edge portion from which it is outwardly disposed.

In view of the foregoing, it may be understood that the present basket bottom forming apparatus 10, 100 and associated method enable the basket maker to craft well made basket bottom/upsplint assemblies 28, 128 suitable for shallow, intermediate or deep baskets with a single form.

The present invention is not intended to be limited to the two preferred embodiments that have been described and illustrated in substantial detail. Variations and modifications from the foregoing specification and drawing may be made by those skilled in the art without departing from the spirit of the invention or the scope of the following claims.

What is claimed is:

1. Apparatus for forming a basket bottom having a predetermined number and configuration of angularly related sets of basket splints, said apparatus comprising:

a working surface;

stop means for positioning on the working surface one end of each of the basket splints in one of the angularly related sets;

site means for providing at least two stop locating sites on the working surface; and fastening means for releasably securing the stop means to the working surface at a selected one of said at least two sites.

2. The apparatus according to claim 1, wherein the stop means, site means and fastening means are provided for each of the angularly related sets of basket splints.

3. The apparatus according to claim 1, wherein the stop means comprises an alignment rim.

4. The apparatus according to claim 1, wherein the site means comprises a slot.

5. The apparatus according to claim 4, wherein the fastening means is adapted to slidably engage the slot.

6. The apparatus according to claim 4, wherein the fastening means comprises a bolt adapted to extend upwardly through the slot to engage the stop means and further comprises a nut adapted to be threaded downwardly on the bolt to engage said stop means.

7. The apparatus according to claim 1, wherein the site means comprises a socket at each of said at least two sites.

8. The apparatus according to claim 7, wherein the fastening means comprises a pin adapted to engage the stop means and to extend downwardly into the socket at the selected one of said at least two sites.

9. The apparatus according to claim 1, wherein the site means comprises a socket at each of said at least two sites and a slot, said sockets being disposed in spaced relation to said slot.

10. The apparatus according to claim 9, wherein the fastening means comprises a bolt adapted to extended upwardly through the slot to engage the stop means, a nut adapted to be threaded downwardly on the bolt to engage the stop means, and a pin adapted to engage the stop means and to extend downwardly into the socket at the selected one of said at least two sites.

11. The apparatus according to claim 1, said apparatus further comprising: a bottom locating area on the working surface, said bottom locating area having perimeter edge portions.

12. The apparatus according to claim 11, wherein the site means, stop means and fastening means are disposed outwardly from each of at least two of the perimeter edge portions.

13. The apparatus according to claim 12, wherein the stop means is approximately equal in length to the perimeter edge portion.

14. The apparatus according to claim 12, wherein the stop means is releasably secured to the working surface in generally parallel relation to the perimeter edge portion.

15. The apparatus according to claim 12, wherein the site means is disposed on the working surface in generally perpendicular relation to the perimeter edge portion.

16. A method of forming a basket bottom having a predetermined number and configuration of angularly related sets of basket splints, said method comprising the steps of:

selecting one of at least two stop locating sites provided on a working surface by site means;

releasably securing stop means at the selected one of said at least two sites on the working surface by fastening means;

positioning one end of each of the basket splints in one of the angularly related sets at said stop means; and arranging the basket splints into the predetermined number and configuration of angularly related sets.

17. The method according to claim 16, wherein said step of selecting one of at least two sites, said step of releasably securing stop means and said step of positioning one end of each of the basket splints are performed for each of the angularly related sets of basket splints.

18. The method according to claim 16, wherein said step of releasably securing stop means comprises extending a bolt through a slot to engage the stop means and threading a nut downwardly on the bolt sufficiently to engage the stop means and to hold said stop means against the working surface at the selected one of said at least two sites.

19. The method according to claim 16, wherein said step of releasably securing stop means comprises engaging the stop means with a pin and extending said pin downwardly into a socket at a selected one of said at least two sites.

20. The method according to claim 16, wherein said step of selecting one of at least two sites, said step of releasably securing stop means and said step of positioning one end of each of the basket splints are performed outwardly from each of at least two perimeter edge portions of a bottom locating area on the working surface.

* * * * *